US008434168B2

(12) United States Patent
Paulson

(10) Patent No.: US 8,434,168 B2
(45) Date of Patent: May 7, 2013

(54) WEIGHT BALANCING FACE SHIELD

(76) Inventor: Roy Paulson, Temecula, CA (US)

( * ) Notice: Subject to any disclaimer, the term of this patent is extended or adjusted under 35 U.S.C. 154(b) by 33 days.

(21) Appl. No.: 13/269,276

(22) Filed: Oct. 7, 2011

(65) Prior Publication Data

US 2012/0084904 A1 Apr. 12, 2012

Related U.S. Application Data

(60) Provisional application No. 61/390,986, filed on Oct. 7, 2010.

(51) Int. Cl.
*A61F 9/06* (2006.01)

(52) U.S. Cl.
USPC ..... 2/427; 2/453

(58) Field of Classification Search ..... 2/6.3, 6.4, 2/6.5, 6.7, 8.2, 15, 10, 427, 431, 448, 449, 2/450, 451, 452, 453
See application file for complete search history.

(56) References Cited

U.S. PATENT DOCUMENTS 3,067,426 A * 12/1962 Tompkins ..... 2/8.1
4,124,902 A * 11/1978 Seres et al. ..... 2/10
4,442,551 A * 4/1984 Hellberg ..... 2/10
4,479,738 A * 10/1984 Kubnick ..... 403/329
4,796,308 A * 1/1989 Bourgeois ..... 2/10
5,966,738 A * 10/1999 Wang Lee ..... 2/10
6,041,435 A * 3/2000 Paulson et al. ..... 2/10
6,264,392 B1 * 7/2001 Wise et al. ..... 403/112
6,457,180 B1 * 10/2002 Jung ..... 2/12
7,152,250 B2 * 12/2006 Phillip, Sr. ..... 2/195.1
7,260,850 B2 * 8/2007 Ambuske et al. ..... 2/6.3
7,546,645 B2 * 6/2009 Goodhand et al. ..... 2/424
7,975,319 B2 * 7/2011 Moore et al. ..... 2/424
8,161,576 B2 * 4/2012 Lemke et al. ..... 2/418
8,209,816 B2 * 7/2012 Heger et al. ..... 16/334
8,214,920 B1 * 7/2012 Edgar et al. ..... 2/8.2
8,286,269 B2 * 10/2012 Springer et al. ..... 2/422
8,291,513 B2 * 10/2012 Prinkey ..... 2/15

* cited by examiner

*Primary Examiner* — Danny Worrell
(74) *Attorney, Agent, or Firm* — Donn K. Harms

(57) ABSTRACT

A rotational engagement component to engage a lens for facial protection, to headwear such as a helmet worn on the head of a user. The device features one or a plurality of mounts engageable to the helmet. A pivot engaged with the mount and with the lens, allow rotation of the lens from an as-used position in front of the user, to a horizontal stowed position. The pivot is translatable in its engagement to the mount allowing for translation of the lens in the stowed position to adjust its center of gravity on the user's head.

12 Claims, 10 Drawing Sheets

WEIGHT BALANCING FACE SHIELD

This application claims priority to U.S. Provisional Patent Application No. 61/390,986, filed on Oct. 7, 2010 and included herein in its entirety by this reference.

BACKGROUND OF THE INVENTION

1. Field of the Invention

The disclosed invention relates generally to helmet or head-mounted face shields and guards. More specifically, it relates to an improved face shield adapted for engagement with a protective helmet which rotates the protective shield to a balanced retracted position when not being employed.

2. Prior Art

Whether working with heavy machinery, dangerous equipment or power tools, safety is always a concern. Face protection has always been important and comes in various forms such as goggles, shields, etc. Although goggles can be very beneficial to eye protection, when it comes to full face protection, such as in welding or operating machinery, a face covering shield is the more desirable choice.

Commonly, face shields are mounted to a helmet or other head engaged mount, via a hinge mechanism. Such conventional hinge mechanisms allow the wearer to pivot the shield from a stowed horizontal position above the face and out of the line of sight to the as-used vertical position directly in front of the face.

One conventional means to position and maintain the glass or plastic shield in either such position is by a rotational engagement employing a hinge. Such hinges conventionally have a tightening mechanism imparting variable pressure to the hinge components which yields a slower rotation or cessation in rotation. The compressive force thus impedes hinge rotation via creation of friction.

This type of hinge system, in order for the user to reposition the shield, requires the user to constantly turn a dial to loosen and tighten the hinge every time a position change is desired. Such a tedious requirement can be a distracting and sometimes dangerous task especially when performing in hazardous environments such as welding or other metal work. Similarly, the tightening mechanism can become worn to the point of no longer providing sufficient frictional force to maintain the shield in a secure position. Further, the user can forget to tighten the mechanism and thereafter the shield can drop at a very inconvenient or even dangerous moment.

Another means for securing the position of the shield is by a step system that requires substantial user interface to induce rotation during a relocation of the shield. This type of system allows the shield to rotate in discrete increments in a ratchet type action, and retain the position desired by the user. Unfortunately, this system is also prone to wear to the point of no longer being able to hold a secure position, which again can be distracting and dangerous to the user.

Along with the shortcomings described above, the simple hinge design itself fails in areas of comfort and ease of maneuverability for the user when the shield is in the upright horizontal position. Currently, when the shield is rotated and secured in the horizontal position, the weight of the shield is substantially forward on the helmet worn on the user's head. This causes uneven weight distribution and extraneous stress and strain on the user's neck. Additionally, the loading of the weight of the shield, on the forward section of the helmet, can cause the helmet itself to rotate forward or fall off the user's head. Further such uneven weight distribution can cause fatigue and even permanent neck damage as time goes on.

Similarly, it may be difficult for the wearer to move and work with this nuisance which is undesirable.

All these problems associated with conventional head and helmet mounted face shield systems can combine to cause users to resist or fail to employ their safety shields properly if they tire of the adjustments required or the improper balance causing them pain and inconvenience. Such can lead to severe injury to the face and eyes of the user.

In conventional shield and helmet matings, there is also often seen a seal at the upper most portion of the shield in order to prevent debris from entering and obstructing the view of the wearer. Although practical, this feature tends to inhibit air flow behind the shield and in front of the user's face. This can in fact increase $CO_2$ buildup within the confines of the shield and also can lead to fogging. This lack of air flow thus introduces another safety hazard for the wearer and is therefore undesirable since the user cannot see through a fogged shield.

Face shields used for the specific task of electric arc flash protection (such as what one would encounter while welding or for electrical industry workers) will often incorporate chin protector portions which are added to the existing product. This feature allows the user to be protected from radiation generated from arc flashes emanating from angles below the shield, and reduces the chance of blinding as well as debris entering. However, since the chin protectors are often supplied separately from the face shield manufacturer and then user-added, they may not be optimized at the same rating of arc protection as the shield itself, rendering the addition of the feature useless.

As can be discerned from the shortcomings of the prior art there is an unmet need for a face shield system that can provide secure and stabile position changes during use. Such a system should not require constant compression and decompression by the user of the components. Such a device should also provide weight balancing when engaged in the stored position on the user's head in order to maintain the user's comfort and maneuverability while employing the device in any position.

SUMMARY OF THE INVENTION

The device and method herein provides a solution to the above noted shortcomings in the prior art. As disclosed and described herein, the shortcomings of prior art are overcome by a face shield device for rotational engagement of a face shield with a helmet with ease. The rotational components employ front and rear assemblies with left and right portions.

In its current configuration, the device herein is adaptable for operative engagement to any helmet worn by users requiring a face shield through the employment of means for engagement to any such helmet or head securement device as employed by the user.

The front-located lens assembly of the device includes a framed or substantially rigid lens having an upper and lower portion which combine to form the face shield which is employable for use as the protective shield. In use, in the as-used position, with the lens lowered in front of the user and protecting the face of a user, the lens assembly is in a substantially vertical position providing protection for the user from flying objects and/or arc flashes. From the as-used position, the lens may be rotated upon hinge assemblies to a stowed horizontal position atop the headwear of the user.

The hinge assemblies are in mirrored positions about the left and right sections of the headwear of the user.

The hinge assemblies are engaged upon and translatable upon a track system which is engaged to the user headwear.

This combination rotation and translation system allows for rotation of the lens to and from the as-used position, and a translation of the lens portion of the device about the hinge to balance the heavy lens on the headwear and user's head when in the raised stowed position above the user's head.

The tracking system restricts rotational movement of the front assembly to rotation from a substantially vertical to substantially horizontal position. Once in the horizontal stowed position, the track allows the user to translate the framed shield assembly toward the rear end of the helmet on which the device is engaged, thereby providing a means to balance the device on the user's head by displacing the center of the mass noticeably over the hinge assemblies.

When this stowed and rearward-translated position is achieved, rotational movement of the lens assembly is prohibited by the track and locks the lens assembly in the stowed position. This of course provides a means to prevent accidental rotation of the lens to the as-used position. Only when the lens assembly is translated again toward the front end of the tracking system can it then be rotated downward to the vertical as-used position. This aspect of the current invention alleviates the problems noted earlier by providing a neutral balance on the user's head when used in the horizontal stowed position. Additionally, an automatic locking and means to prevent rotation is provided by translating the shield to the stowed position alleviating the need to rotate knobs or invoke locking mechanisms of conventional shield devices.

In a preferred mode the upper most portion of the front positioned lens includes ventilation ribs which provide a means for natural convection of air flow upward and through the top of the shield. This maximized airflow alleviates fogging as well as $CO_2$ buildup and further improves comfort for the user.

In another preferred mode, the device, engaged at the distal lower edge of the face shield, there is incorporated a cooperatingly engageable chin protector engaged about the lower portion of the front lens assembly. While the chin protector can be made removably engageable, it is also preferred that the chin protector cannot be removed from the face shield and still remain functional as to ensure proper use.

In yet another preferred mode, the device incorporates a detachable light source that can be user manipulated to any orientation and direction.

In still yet another preferred mode, the lens of the face shield contains a unique mechanical pattern matching with that of the frame as to ensure the proper lens is always used with the frame for the task at hand.

With respect to the above description, it is to be understood that the invention is not limited in its application to the details of operation of the invention nor the arrangement of the components or steps in the method set forth above or in the following descriptions or in the illustrations in the drawings. The various methods of implementation and operation of the disclosed device herein, are capable of other embodiments and of being practiced and carried out in various ways which will be obvious to those skilled in the art once they review this disclosure. Also, it is to be understood that the phraseology and terminology employed herein are for the purpose of description and should not be regarded as limiting.

Therefor, those skilled in the art will appreciate that the conception upon which this disclosure is based may readily be utilized as a basis for designing similar devices for carrying out the several purposes of the present invention. Therefor, the objects and claims herein should be regarded as including such equivalent constructions, steps, and methodology insofar as they do not depart from the spirit and scope of the present invention.

It is an object of this invention to provide a face shield assembly that allows a user to rotate the shield to a horizontal position and further translate it backward and thereby provide a means to more effectively balance the weight of the shield assembly over the users head to a neutral position providing more comfort and ease of maneuverability.

It is another object of the invention to allow for engagement of the device to any hard hat or helmet of the like.

It is yet another object of the invention to provide a light source for the user.

Another object of the invention is the provision of automatic rotation locking to prevent the shield from unintentionally rotating to a vertical as-used position.

It is still yet another object of the present invention to provide a means to ensure proper installation of the shield lens into its frame.

A further object of the invention is to allow for natural convection air flow by means of ventilation ribs about the upper most portion of the face shield assembly.

These together with other objects and advantages which become subsequently apparent reside in the details of the construction and operation of the lens positioning system herein as more fully hereinafter described and claimed, reference being had to the accompanying drawings forming a part thereof, wherein like numerals refer to like parts throughout.

BRIEF DESCRIPTION OF THE FIGURES

FIG. 3 is a front view of the device in the as-used position, showing the relative size of the lens assembly as compared to the hard hat or helmet of the like.

DETAILED DESCRIPTION OF THE PREFERRED EMBODIMENTS OF THE INVENTION

Figure 1:
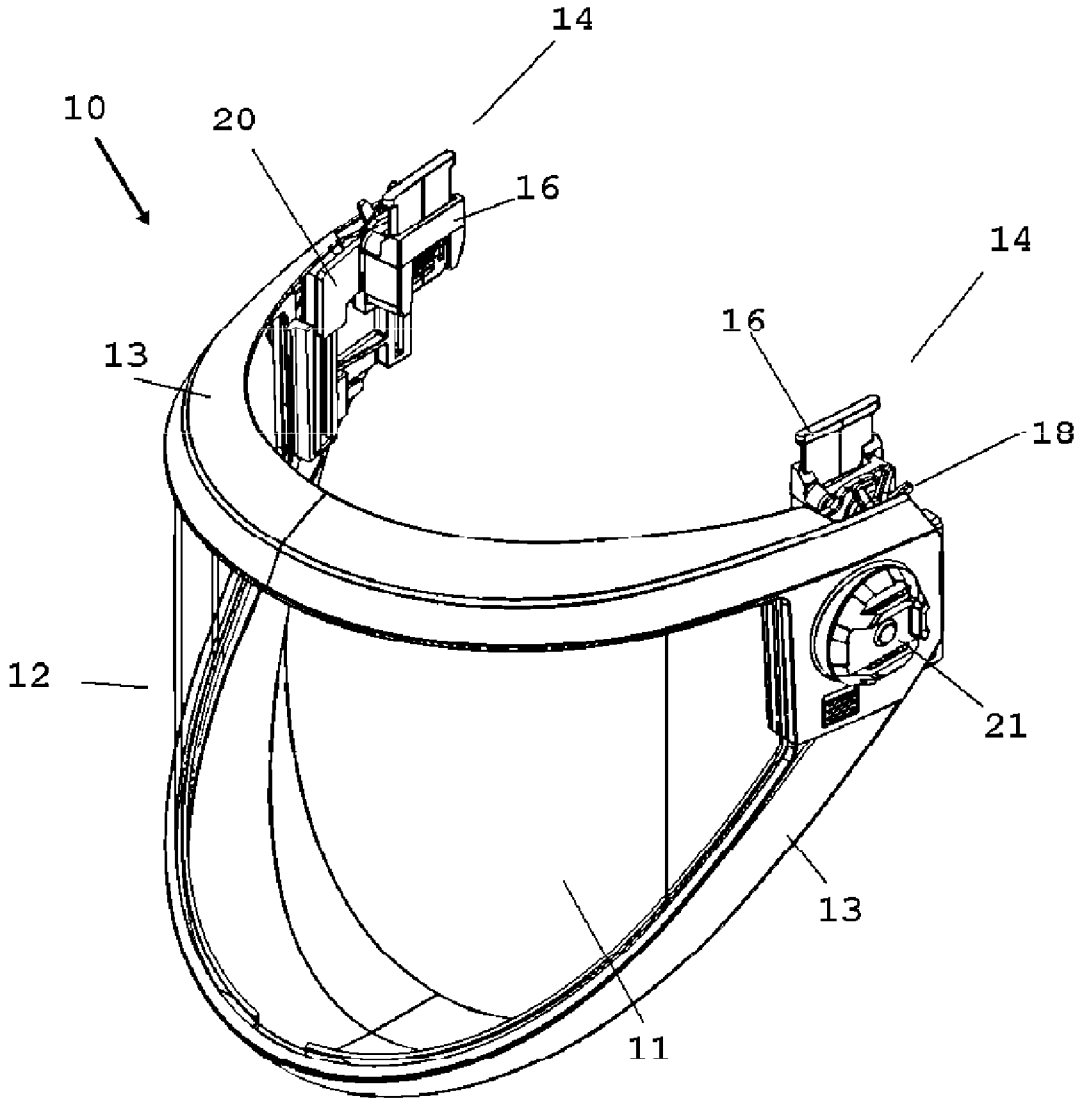
FIG. 1 depicts an isometric perspective view of the device herein disclosed, showing the lens and hinge assemblies adapted for engagement to headwear such as a helmet or head band or other head engagement means.

Now referring to drawings in FIGS. 1-10, wherein similar components are identified by like reference numerals, there is seen in FIG. 1 a mode of the device 10 having a front lens assembly 12 and rear hinge assemblies 14. The front lens assembly 12 is comprised of the protective transparent lens 11, a frame 13, and means for illumination shown as a light system 21. The light system 21 allows for engagement of a light source (not shown) that can be rotationally adjusted by the user.

The hinge assemblies 14 contain helmet engagement adaptors 16 and a track system 20 noted in detail below. The adaptors 16 shown herein provide means for engagement of the device 10, to a helmet or the like, and are merely exemplar of one mode of such a means to engage the device 10 to a helmet 30 such as by adhesive to the interface provided by the adapter 16, (see FIG. 2), and may take on other forms such as clips or fasteners or the like as would occur to those skilled in the art. As such, any means of engagement of the device 10 to headwear such as a helmet 30 such as would occur to those skilled in the art is anticipated within the scope of this patent. Such engagement means could include cooperating fasteners on the helmet 30 and adapter 16 or in place thereof, compression clamps around the headband, magnetic engagement between the adapter 16 and helmet 30 and device 10, screws, bolts, snaps, and other such fasteners which provide either a permanent or removable engagement.

Figure 2:
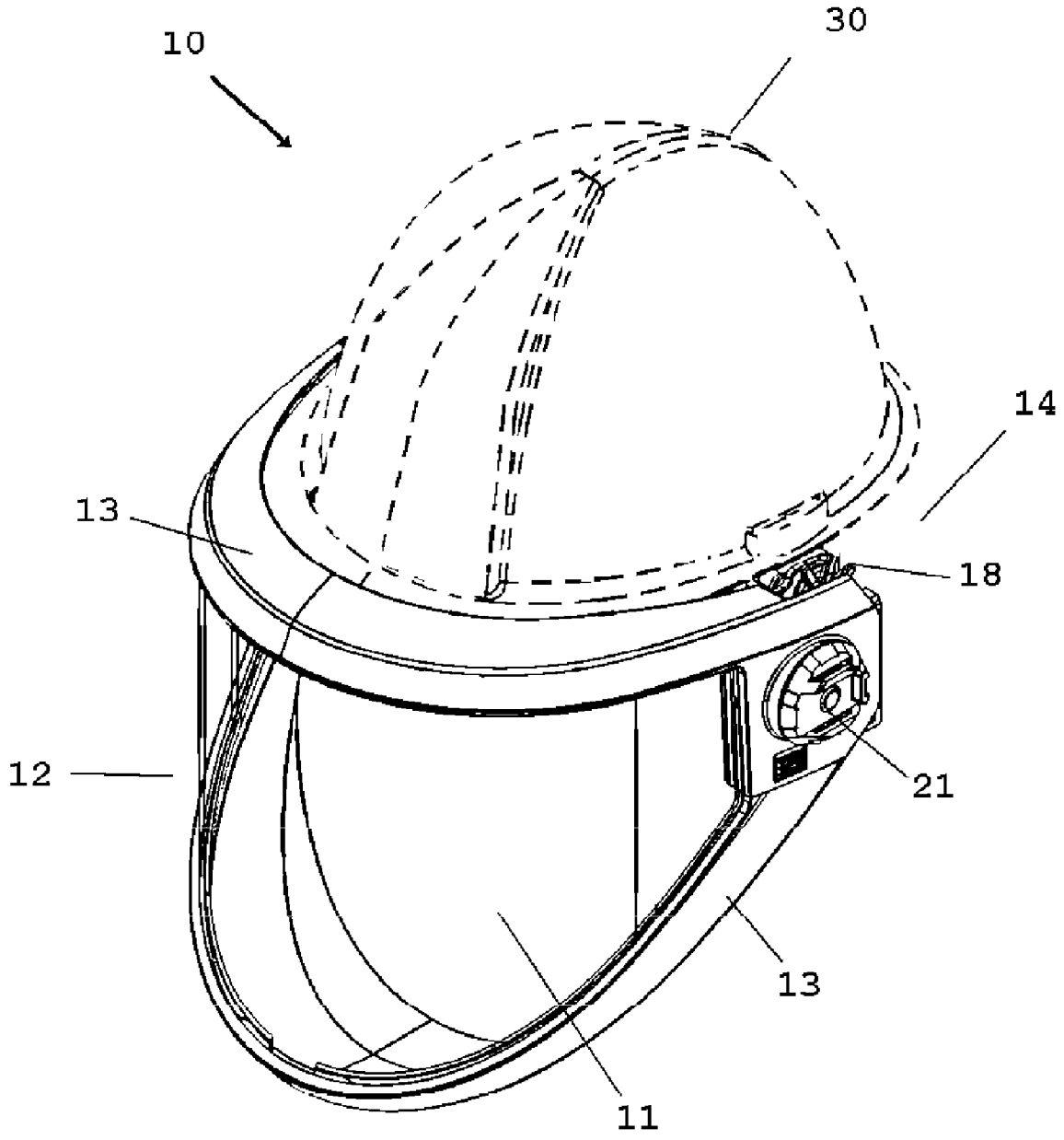
FIG. 2 depicts the device as described in FIG. 1 in the as-used position in a typical engagement to a hard hat or helmet of the like portrayed by the dashed line.
Figure 3:
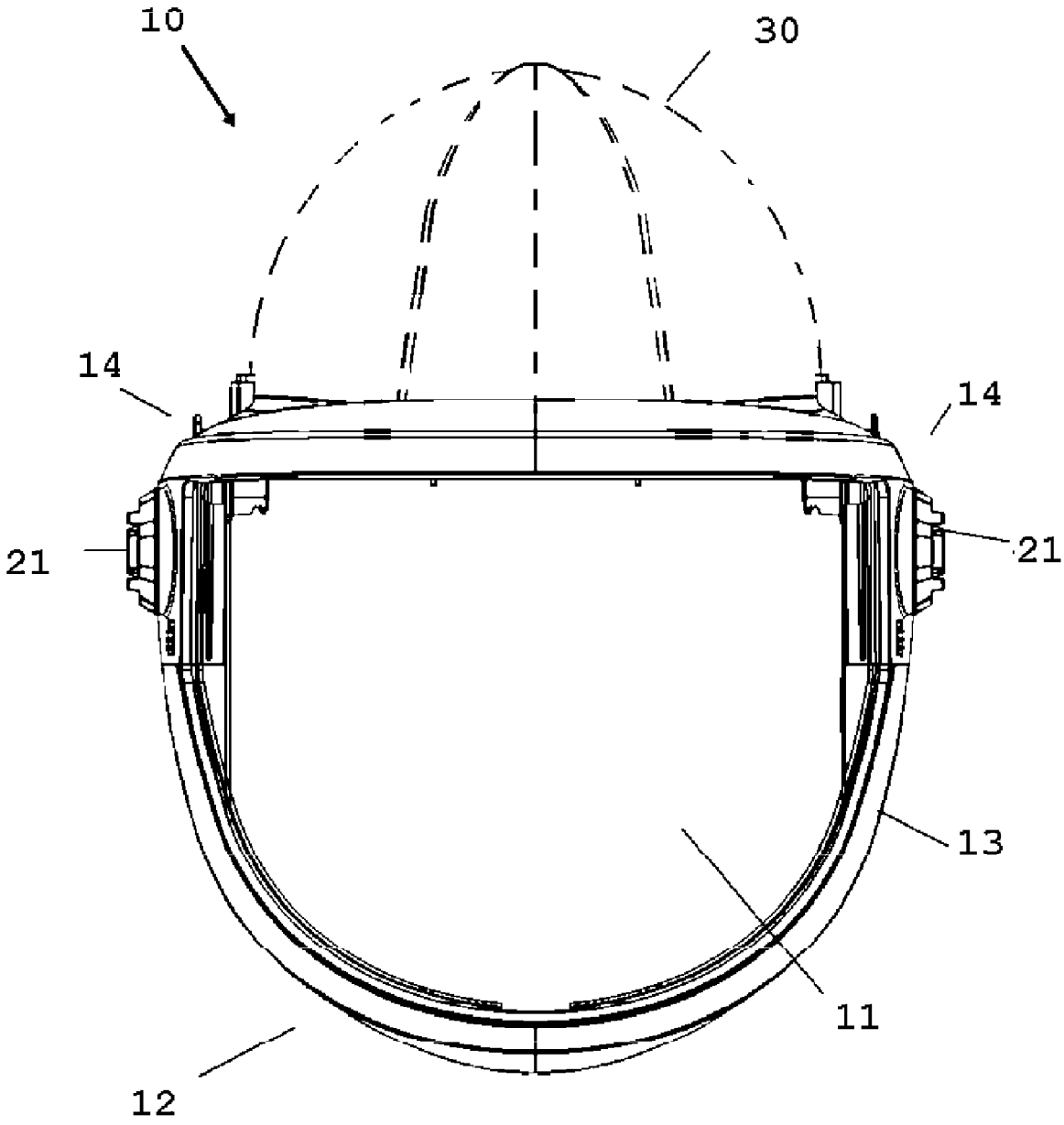

FIG. 2 depicts the device 10 as it would be engaged to a conventional hard hat or helmet shown by the dashed line, and is shown with the lens assembly 12 which includes the lens 11 and optionally includes the frame 13, in the substantially vertical as-used position where full face protection is provided to the wearer. Of course with proper engagement and material forming the lens 11 it may be employed minus the frame 13. FIG. 3 shows a front view of the device 10 as described in FIG. 2.

Figure 4:
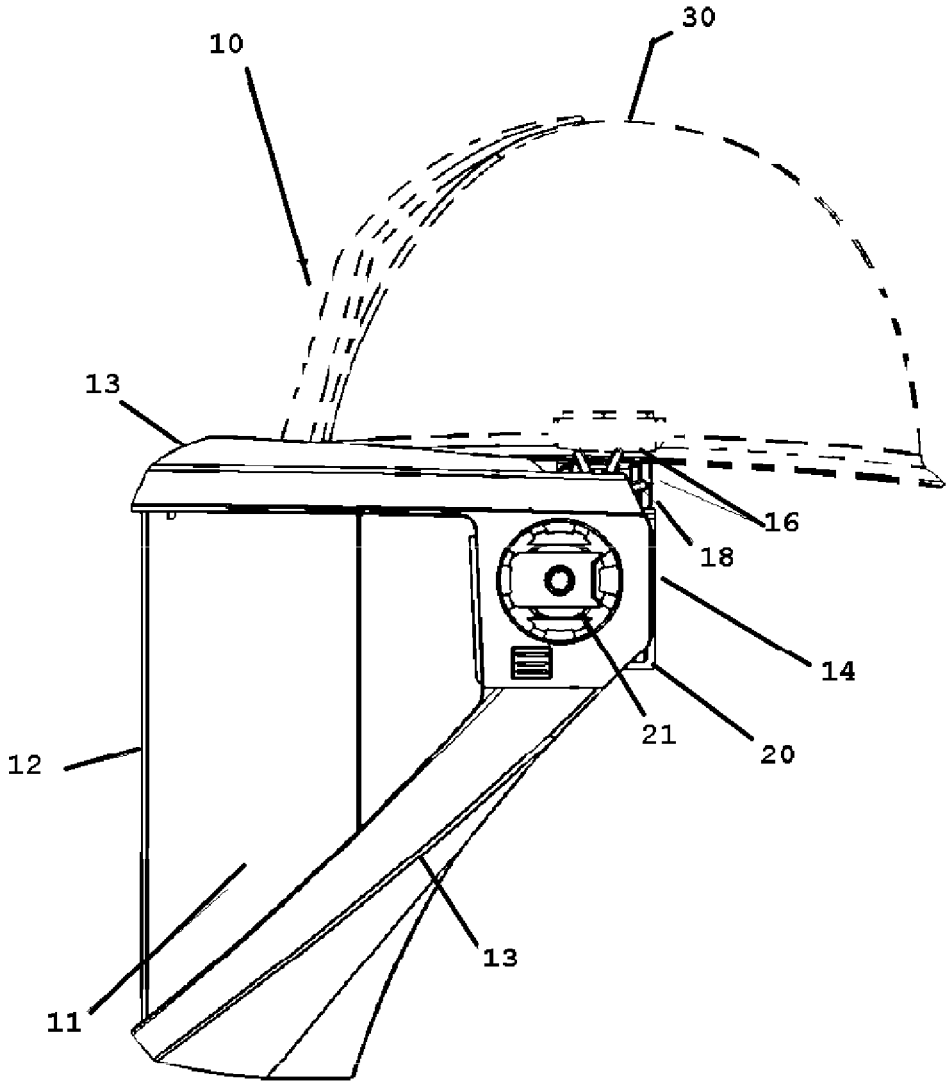
FIG. 4 is a side view of the device showing the lens assembly in the as-used vertical position.

A side view of the device 10 in the as-used position is seen in FIG. 4. The lens 11 and lens assembly 12 is in the as-used, substantially vertical position, providing frontal and side face protection to the wearer. Also depicted is the lens 11 and frame 13 is operatively engaged or in a communicative engagement to the support rail 24 of the track system 20 and consequently with the hinge assembly 14. This engagement can be with mating component 25 or direct with the object being engagement to the track system 20 for both pivoting and translating. Further, it should be noted that while the specification depicts two mounts with one on each side of the helmet 30, one mount may be employed if the means of engagement of the lens 11 or lens assembly 12 of lens and frame, is sufficiently strong to hold the lens 12 in the as-used position and during the pivot to the stowed position. However, a particularly preferred mode is that with two pivots and mounts for additional stability and safety.

Means of engagement of the lens assembly 12 through engagement with the lens 11 or the frame 13 using a member such as mating component 25 or other operative means of engagement to the track system 20 may be, but is not limited to, one or a combination of attaching components to engage the lens assembly 12 or its part, with a mating component 25. Such engagement means may include one or a combination of connectors such as nut and bolt connectors or adhesive, or screws, or cooperating fasteners, heat welding, or other engagement means one skilled in the art would employ, as they both move in unison. A collection of applicable such connectors is available in the GRANGER 2010 catalog which are made part hereof.

Figure 5:
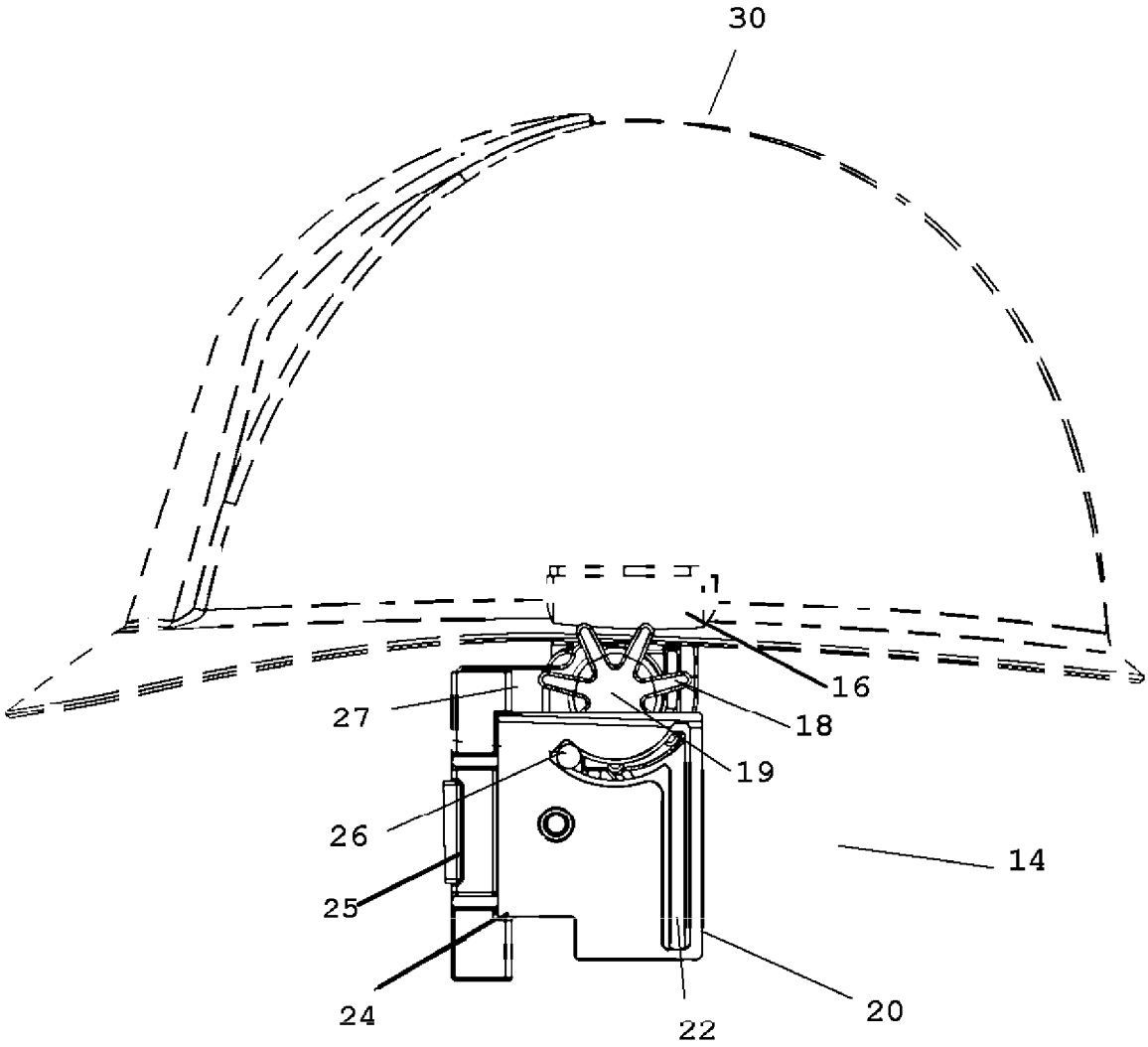
FIG. 5 shows the position of the tracking system with the lens assembly positioned as described in FIG. 4 with lens assembly omitted for demonstration purposes.

The positioning of the track system 20 relative to the helmet 30 can be seen in FIG. 5 where the front lens assembly 12 has been omitted for demonstrative purposes. The track system 20 can be seen to function employing the track 22, support rail 24, slide adapter 27, track guide pin 26, and thumbscrew 18. The thumbscrew 18 which is inline with the pivot 19, allows the wearer to make minute adjustments for better comfort and viewing range.

Figure 6A:
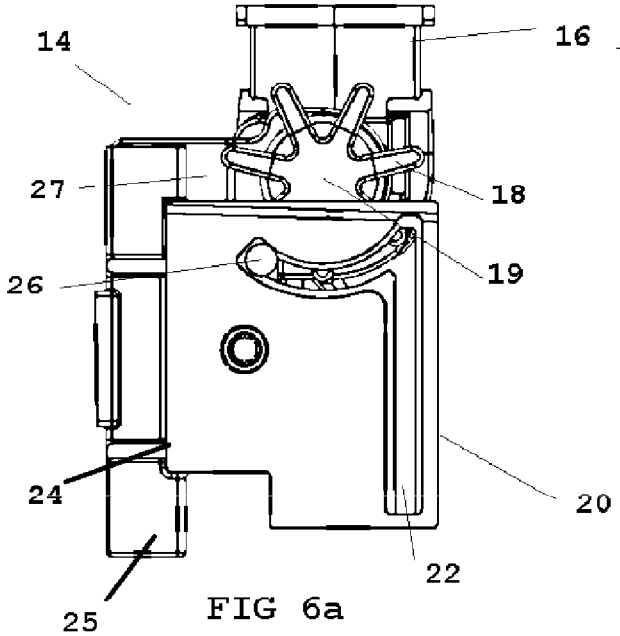
FIG. 6*a* depicts an isolated side view of the hinge assembly showing the track, track guide pin, pivot, thumbscrew, helmet adapter, support rail, and rail adapter.
Figure 6B:
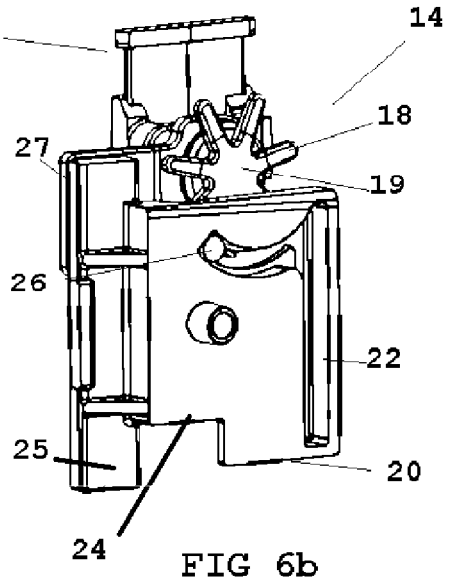
FIG. 6*b* shows an isometric view of the hinge assembly as described in FIG. 6*a* for demonstrative purposes.
Figure 6C:
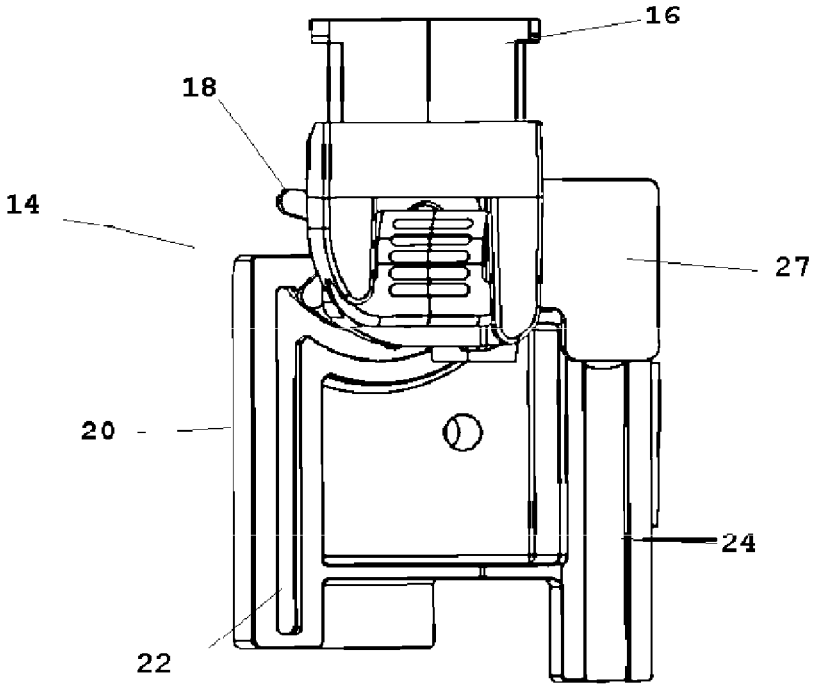
FIG. 6*c* shows the back side of the hinge assembly.

The track system 20 is engaged to the pivot 19 at the support rail 24 via the slide adapter 27. FIG. 6*a-c* better depict the isolated hinge assembly 14 showing the detailed track system 20. The slide adapter 27 rotates freely about the pivot 19. This engagement of the slide adapter 27 to the support rail 24 allows for a means for translation of the support rail 24 and track 22, toward and away from the front of the helmet, when the shield is rotated fully to the horizontal stowing position as will be described shortly. The track guide pin 26 is engaged to the helmet adaptor 16 of which remains stationary as the front lens assembly 12 and remaining components of the track system 20 rotate about the pivot 19. It should be noted, that the track system herein, can be employed with any helmet, and any face shield and provide a significant improvement in the art. Consequently, the device 10 may be provided as the track system 20 adapted to engage headwear such as a helmet and adapted to engage the face shield of the user's choice, and provide the utility and novelty of the device herein.

Figure 7:
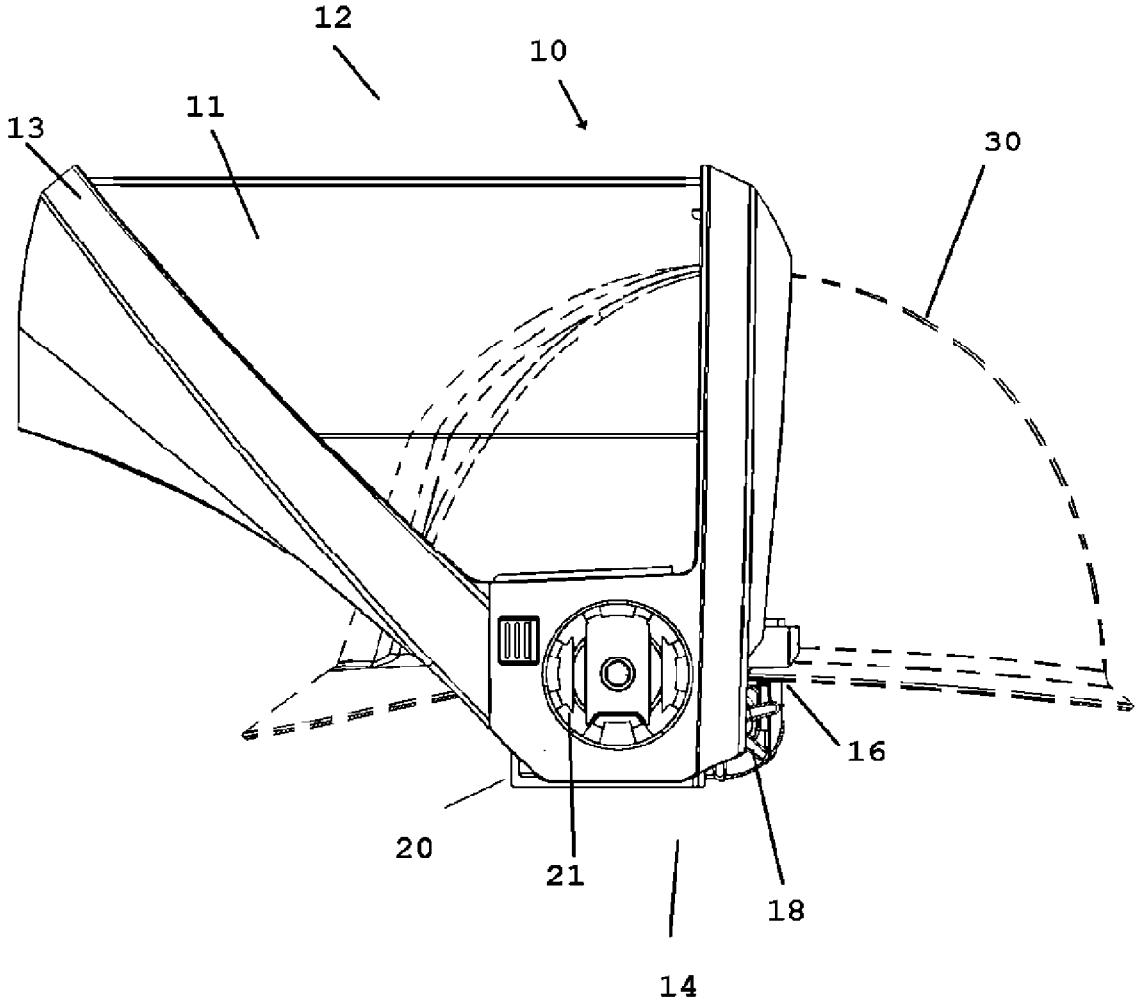
FIG. 7 is a side view of the device showing the lens assembly in the horizontal stowed position prior to translation to balance the weight of the device on the user's head.

The track 22 has an initial constant radius arc section followed by a substantially linear section as seen in the depictions. The track guide pin 26 restricts the initial movement to rotation through the constant radius arc section, about the pivot 19. The position of the lens assembly 12 after rotation is seen in FIG. 7.

Figure 8:
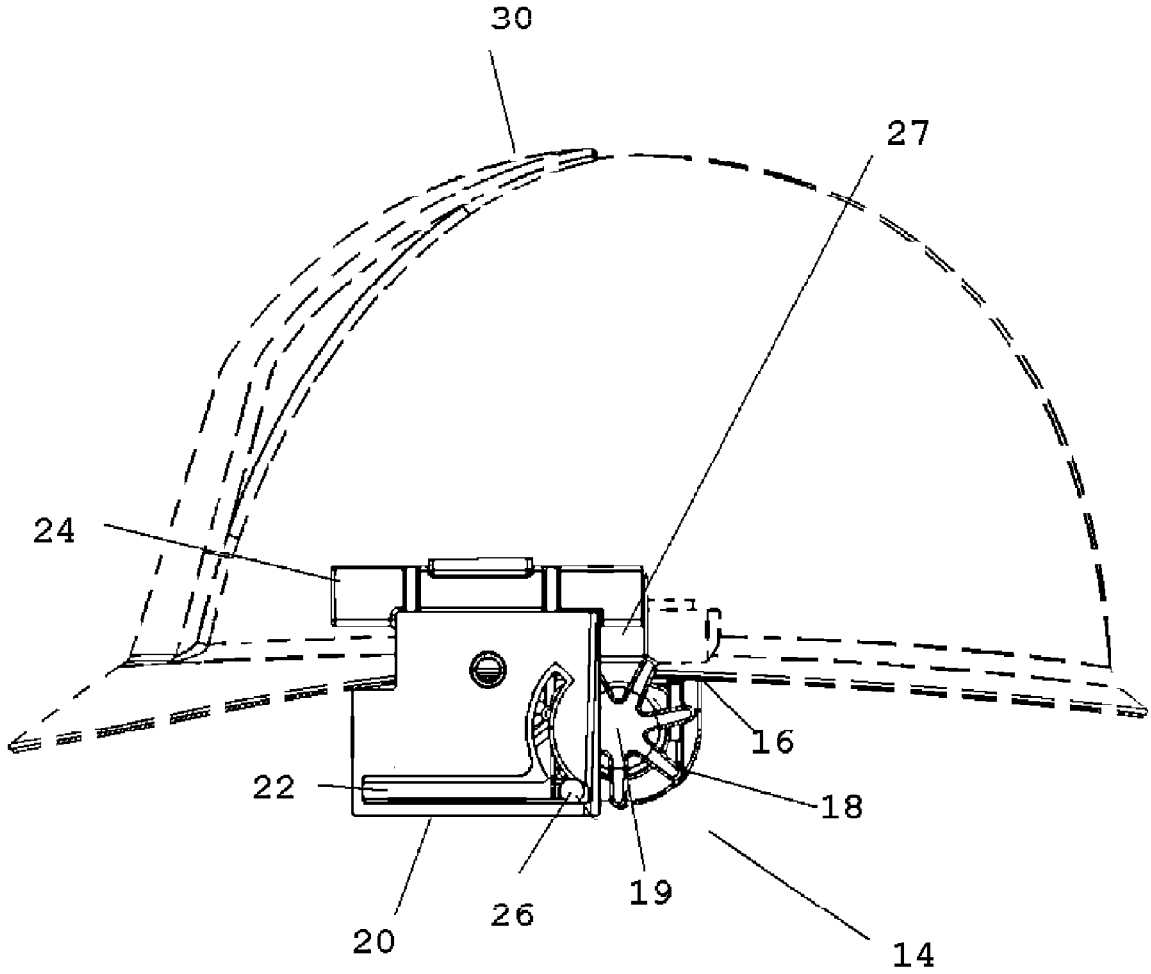
FIG. 8 shows the position of the tracking system with the lens assembly positioned as described in FIG. 7 with lens assembly omitted for demonstration purposes.

Again, for demonstrative purposes the position and orientation of the track system 20 can be seen in FIG. 8 with the lens assembly 12 omitted. Since the guide pin 26 has remained stationary it can be seen that the track 22, is now positioned with the guide pin 26 at the beginning of the straight or linear section of the track 22. It is noted that the constant radius arc section allows for a substantially 90 degree rotation of the aforementioned engaged components and the lens assembly 12 whereby it may be rotated from the as-used position to the stowed position.

Figure 9:
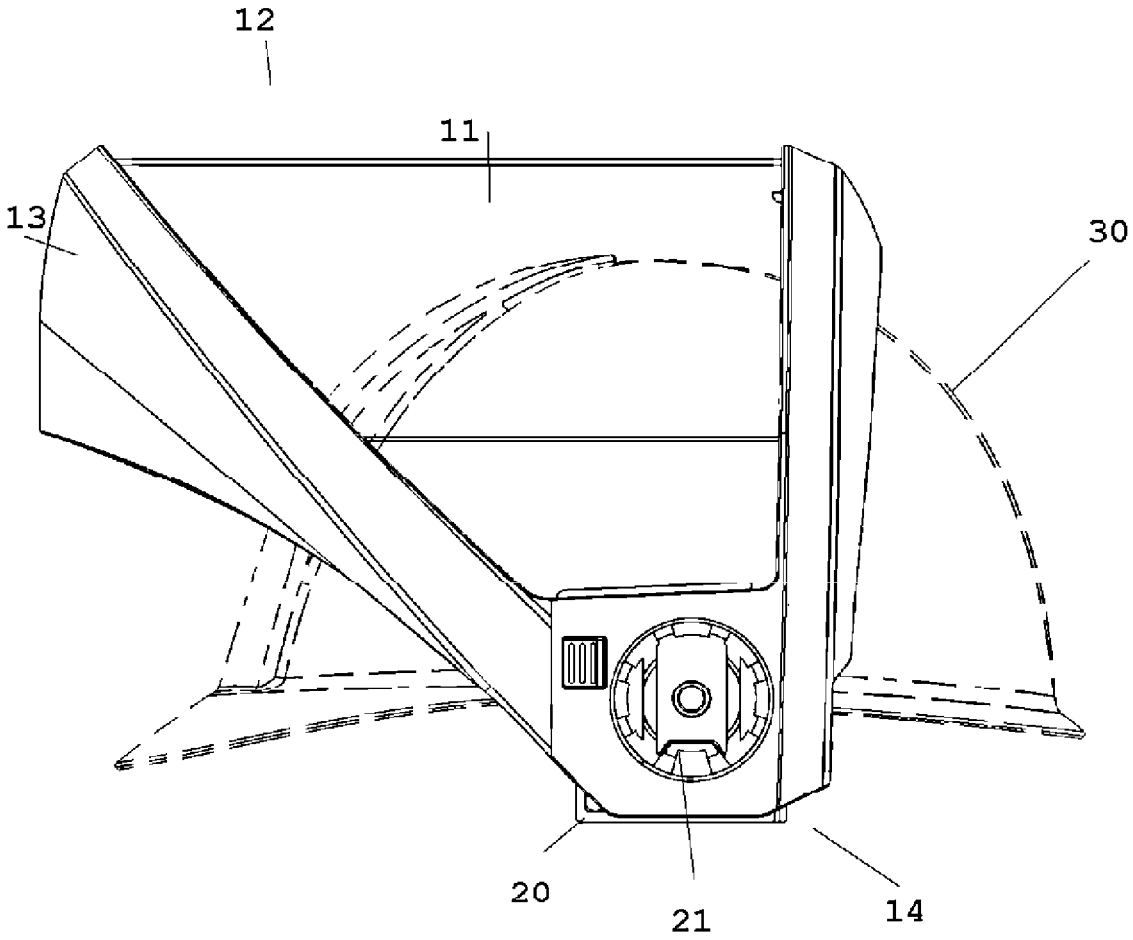
FIG. 9 is a side view of the device showing the lens assembly translated to the rear of the hard hat or helmet or the like providing a means to achieve a neutral balance about the users head.
Figure 10:
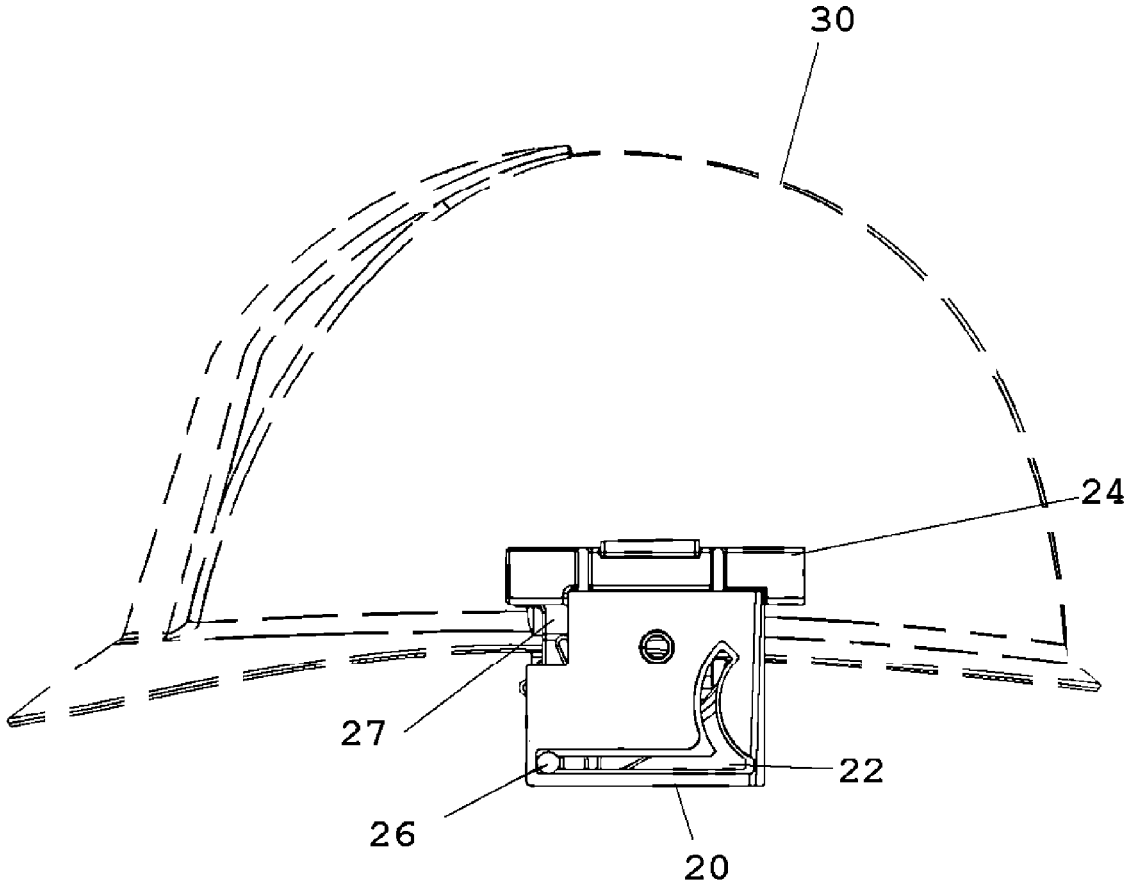
FIG. 10 shows the position of the tracking system as it would be when the lens assembly positioned as described in FIG. 9 with lens assembly omitted for demonstration purposes.

Once rotated to the horizontal or stowed position, the lens assembly 12 only then may be translated towards the rear of the hinge assembly 14. This means for rearward translation of the lens assembly, thereby providing a means to shift the center of mass of the lens assembly 12, upon the headwear or helmet 30 worn by the user, toward a central portion of the helmet 30 from the front portion which is just above the wearers forehead as described in the summary of the invention. This translation provides the means for centering of the weight of the device 10 including the lens assembly 12, on the user's head toward the rear where it reaches the center of their head where there is less neck strain. The position of the lens assembly 12 with respect to the helmet 30 after translation to the rear of the device 10 is seen in FIG. 9. In order to demonstrate the mechanics of the device 10, the lens assembly 12 is omitted and the track system 20 is thereby exposed as seen in FIG. 10.

The substantially linear or straight section of the track 22 restricts motion of the track system 20 to translation only once the lens assembly 12 is rotated to a horizontal or stowed position. Also depicted in FIG. 10, the support rail 24 and track 22 are translatable toward the rear of the helmet and away from the front edge and from a user's face due to the pathway provided by the slide adapter 27 and guide pin 26 respectively. As depicted, once the device 10 is locked and in the horizontal and stowed position, intentional user action is required to return the lens assembly 12 to the as-used position set forth by the process just described. This provides a means to prevent accidental pivoting of the lens assembly 12 in front of the user's face which could cause loss of forward view or other problems.

While all of the fundamental characteristics and features of the weight balancing rotationally engaged face shield invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A rotational engagement of a face shield for facial protection, to headwear such as a helmet worn on the head of a user, comprising:

a mount engageable to said helmet between a front end of said helmet positioned above the eyes of said user wearing said helmet, and a rear end of said helmet opposite said front end;

a pivot in engaged upon said mount;

means for an attachment of a lens, to said pivot;

said lens in said attachment, rotatable from an as-used position substantially vertical position in front of the face of a user, to a stowed position substantially horizontal and above the eyes of said user;

said pivot translatable in said engagement to said mount toward and away from said rear end, between a first point furthest from said rear end and a second point closest to said rear end;

a translation of said pivot in a direction toward said rear end, producing a sliding of said lens a distance toward said rear end, equal to said translation; and said sliding of said lens along said distance, providing means to adjust a center of gravity of said lens, upon said head of said user.

2. The rotational engagement of a face shield of claim 1, additionally comprising:

a pair of said mounts, each of said pair engaged to a respective opposing side surface of said helmet;

each of said pair of mounts having one of a pair of pivots engaged thereon;

means for an attachment of a lens, to each of said pair of pivots;

each of said pair of pivots translatable in said engagement to a respective said mount, toward and away from said rear end, between a first point furthest from said rear end and a second point closest to said rear end;

a translation of said pair of pivots pivot in a direction toward said rear end, producing a sliding of said lens a distance toward said rear end, equal to said translation.

3. The rotational engagement of a face shield of claim 1, additionally comprising:

means for rendering said pivot translatable in said engagement to said mount, only with said lens rotated to said stowed position.

4. The rotational engagement of a face shield of claim 2, additionally comprising:

means for rendering said pair of pivots translatable in said engagement to a respective said mount, only with said lens rotated to said stowed position.

5. The rotational engagement of a face shield of claim 3, wherein said means for rendering said pivot translatable in said engagement to said mount, only with said lens rotated to said stowed position comprises:

said means for an attachment of a lens, to said pivot comprising a substantially planar member;

a slot communicating through said member;

said slot having a curved section communicating with a substantially straight section;

a pin communicating from a distal end engaged in said slot, to a fixed position on said mount or helmet;

said distal end engaged within said curved section of said slot until said lens is rotated to said stowed position wherein said pin is positioned at a first end of said straight section;

said distal end of said pin engaged with said curved position, preventing said pivot from translating in said engagement with said mount.

6. The rotational engagement of a face shield of claim 4, wherein said means for rendering said pair of pivots translatable in said engagement to a respective said mount, only with said lens rotated to said stowed position comprises:

said means for an attachment of a lens, to said pivots comprising a respective substantially planar member;

a slot communicating through at least one said member;

said slot having a curved section communicating with a substantially straight section;

a pin communicating from a distal end engaged in said slot, to a fixed position on said mount or helmet;

said distal end engaged within said curved section of said slot until said lens is rotated to said stowed position wherein said pin is positioned at a first end of said straight section;

said distal end of said pin engaged with said curved position, preventing said pivot from translating in said engagement with said mount.

7. The rotational engagement of a face shield of claim 1, additionally comprising:

user releasable means to lock said lens in said stowed position.

8. The rotational engagement of a face shield of claim 2, additionally comprising:

user releasable means to lock said lens in said stowed position.

9. The rotational engagement of a face shield of claim 3, additionally comprising:

user releasable means to lock said lens in said stowed position.

10. The rotational engagement of a face shield of claim 4, additionally comprising:

user releasable means to lock said lens in said stowed position.

11. The rotational engagement of a face shield of claim 5, additionally comprising:

user releasable means to lock said lens in said stowed position.

12. The rotational engagement of a face shield of claim 6, additionally comprising:

user releasable means to lock said lens in said stowed position.

* * * * *